US007261023B2

(12) United States Patent
Taguchi

(10) Patent No.: US 7,261,023 B2
(45) Date of Patent: Aug. 28, 2007

(54) BIT HOLDER DEVICE

(75) Inventor: Yasuaki Taguchi, Osaka (JP)

(73) Assignee: Vessel Industrial Co., Ltd., Osaka-shi (JP)

( * ) Notice: Subject to any disclaimer, the term of this patent is extended or adjusted under 35 U.S.C. 154(b) by 0 days.

(21) Appl. No.: 10/556,304

(22) PCT Filed: Jun. 22, 2004

(86) PCT No.: PCT/JP2004/008744

§ 371 (c)(1),
(2), (4) Date: Nov. 9, 2005

(87) PCT Pub. No.: WO2005/000531

PCT Pub. Date: Jan. 6, 2005

(65) Prior Publication Data

US 2006/0230887 A1 Oct. 19, 2006

(30) Foreign Application Priority Data

Jun. 25, 2003 (JP) ..... PCT/JP03/08064

(51) Int. Cl.
*B25B 23/08* (2006.01)
*B25B 23/00* (2006.01)
*B25B 15/00* (2006.01)

(52) U.S. Cl. ..... 81/451; 81/438

(58) Field of Classification Search ..... 81/451, 81/438, 180.1, 125
See application file for complete search history.

(56) References Cited

U.S. PATENT DOCUMENTS 2,276,470 A * 3/1942 Dodelin ..... 81/451
2,300,308 A * 10/1942 Ojalvo ..... 81/451
2,660,080 A * 11/1953 De Kam ..... 81/451
2,718,806 A * 9/1955 Clark ..... 81/125
2,782,823 A * 2/1957 Williams, Jr ..... 81/451
3,392,767 A * 7/1968 Stillwagon, Jr. ..... 81/451
3,707,894 A * 1/1973 Stillwagon, Jr. ..... 81/125
5,012,708 A 5/1991 Martindell
5,724,873 A * 3/1998 Hillinger ..... 81/451
5,806,381 A 9/1998 Lin (Continued)

FOREIGN PATENT DOCUMENTS

DE 19907837 A1 9/2000

(Continued)

*Primary Examiner*—David B. Thomas
(74) *Attorney, Agent, or Firm*—Birch, Stewart, Kolasch & Birch, LLP

(57) ABSTRACT

Provided is a bit holder device which is capable of driving a screw into a workpiece, while holding the screw having a groove in which a bit body is inserted, and which makes it possible to change the bit body without removing it from a chuck of an electric tool, etc.

A bit holder device facilitating the attachment and detachment of a cylindrical body is also provided.

A bit holder device for driving a screw, while holding the screw against detachment from a bit body with retaining a state where an end of the bit body is inserted in a groove on a head of the screw, has a cylindrical cover member removably fitted about the bit body from the end of the bit body, the cover member has an end including a magnetic attracting portion for magnetically attracting the head of the screw, and the bit body protrudes from the end of the cover member.

13 Claims, 14 Drawing Sheets

U.S. PATENT DOCUMENTS

| | | | | |
|---|---|---|---|---|
| 5,996,452 | A | 12/1999 | Chiang | |
| 6,154,108 | A * | 11/2000 | Huang | 335/284 |
| 6,209,426 | B1 * | 4/2001 | Takahashi | 81/451 |
| 6,530,299 | B1 * | 3/2003 | Liu | 81/451 |
| 6,666,114 | B1 * | 12/2003 | Lin | 81/438 |
| 6,684,740 | B2 * | 2/2004 | Lin | 81/438 |
| 6,701,809 | B2 * | 3/2004 | Huang | 81/125 |
| 6,931,967 | B1 * | 8/2005 | Chang | 81/451 |
| 2003/0131694 | A1 * | 7/2003 | Lin | 81/438 |

FOREIGN PATENT DOCUMENTS

| | | | |
|---|---|---|---|
| DE | 10148943 | A1 | 11/2002 |
| EP | 86352 | A2 | 8/1983 |
| EP | 1027959 | A2 | 8/2000 |
| EP | 1260319 | A2 | 11/2002 |
| JP | 153988/1982 | U | 4/1984 |
| JP | 2000-246658 | A | 9/2000 |
| JP | 2000-308974 | A | 11/2000 |

* cited by examiner

BIT HOLDER DEVICE

TECHNICAL FIELD

This invention relates to a bit holder device which enables a job of tightening or the like of a screw, etc., while holding the screw against detachment from a bit body with retaining a state where the bit body is engaged with the groove on the head of the screw, etc.

BACKGROUND ART

A conventional bit holder device which holds a screw, etc. with retaining a bit body inserted in the groove on the head of the screw, etc. to facilitate a job of tightening, driving into a workpiece, or the like of the screw is disclosed in, for example, JP-A-2000-246658.

What is disclosed in that publication consists of a cylindrical body fitted on a bit body attached to an electric tool, and the cylindrical body is provided with holding means (a magnet) for holding a screw with the bit body inserted in the groove of its head.

The use of the cylindrical body has, however, makes the attachment and detachment of the bit and cylindrical bodies cumbersome, since two jobs, that is, the job of removing the bit body from the chuck of the electric tool and the job of removing the cylindrical body from the bit body are required for changing the bit body and attaching the cylindrical body to another bit body.

A bit holder device as disclosed in German Patent Publication DE10148943A1 is known as a type in which the bit body is removably held by a holder body having a shank in its rear portion. The device described in the German Patent Publication has, however, a drawback that the cylindrical body cannot be removed from the holder body.

Patent Literature 1: JP-A-2000-246658

Patent Literature 2: German Patent Publication DE10148943A1

DISCLOSURE OF THE INVENTION

Problems to be Solved by the Invention

In view of these circumstances, it is an object of this invention to provide a bit holder device which is capable of driving a screw into a workpiece, while holding the screw with a groove thereof engaged with a bit body so as not to be detached from the bit body, and which makes it possible to change the bit body easily without removing the bit body from a chuck of an electric tool, etc.

It is another object of this invention to provide a bit holder device which facilitates the attachment and removal of a cylindrical body.

Means for Solving the Problems

In order to attain the above objects, this invention provides technical means as described below.

A bit holder device for driving a screw, while holding it against detachment from a bit body with retaining a state where an end of the bit body is inserted in a groove on a head of the screw, has a cylindrical cover member removably fitted about the bit body from the end of the bit body, the cover member has an end including a magnetic attracting portion for attracting the head of the screw magnetically, and the bit body protrudes from the end of the cover member.

This facilitates a job of changing the bit body, since the cover member is removable and the job of changing the bit body can be performed after the cover member is removed. The screw can be held by the magnetic attracting portion provided on the cover member fitted about a holder body.

The bit body is removably held by the holder body having a shank in its rear portion, and the cover member is fitted about the holder body.

This simplifies the job of changing the bit body, since the bit body can be changed while the shank remains attached to an electric tool, etc.

Movement permitting means is provided between an inner surface of the cylindrical cover member and an outer surface of the holder body for permitting an axial back and forth movement of the cover member relative to the holder body.

With this arrangement, since the back and forth movement of the cover member is permitted by the movement permitting means, the cover member can be retracted when no screw is thereby held, so that the bit body can protrude to a greater extent to facilitate the insertion of a screw into the bit body. Moreover, the magnetic force exerted by the magnetic attracting portion on the screw upon its insertion into the bit body causes the cover member to advance and hold the screw on its magnetic attracting portion.

The Movement permitting means consists of a circumferential groove formed in the outer surface of the cylindrical holder body and an elastic annular member provided on the inner surface of the cover member to be engaged with the circumferential groove, and the circumferential groove has an axial length which is greater than that of the elastic annular member.

This permits the cover member having the elastic annular member to move back and forth to the extent defined by the axial length of the circumferential groove. Accordingly, the distance by which the cover member is permitted to move back and forth can be set by setting the axial length of the circumferential groove.

The holder body is formed in a cylindrical shape and has a portion forward of its circumferential groove having a diameter which is equal to, or slightly smaller than the inside diameter of the elastic annular member.

This enables the elastic annular member to be fitted easily in the circumferential groove of the holder body.

The magnetic attracting portion is an annular magnet provided at a front end of the cover member and the bit body has a tapered tip portion so situated as to cross the front end face of the magnet.

This enables the tapered portion of the bit body to be magnetized by the annular magnet so that the bit body and the magnet may cooperate to hold the screw more securely and thereby tighten it, etc. in a more stable position.

The bit body has a shank integrally formed with its rear portion, and the cover member is directly fitted about the bit body.

With this arrangement, since the cover member is removably fitted about the bit body, the cover member can be easily removed.

The cover member is held by retaining means for preventing detachment of the bit body, and the retaining means is formed of an elastic material to allow the attachment and detachment of the cover member by a human force.

The retaining means formed of an elastic material enables the cover member to be attached or detached easily only by manually pulling the cover member with a force causing the elastic deformation of the elastic material.

The holder body has a raised portion formed at its rear end for positioning the cover member fitted about the holder body.

This enables the cover member to be situated in the same position at any time when the bit holder device does not hold any screw.

The bit body is removably held by the holder body having a shank in its rear portion, the cover member is removably fitted about the holder body, movement permitting means is provided between the inner surface of the cylindrical cover member and the outer surface of the holder body for permitting the axial back and forth movement of the cover member relative to the holder body, the movement permitting means consists of a circumferential groove formed in the outer surface of the cylindrical holder body and an elastic annular member provided on the inner surface of the cover member to be engaged with the circumferential groove, the circumferential groove has an axial length which is greater than that of the elastic annular member, and the elastic annular member defines the retaining means.

With this arrangement, since a screw can be held by the magnetic attracting portion provided on the cover member fitted about the holder body, and since the back and forth movement of the cover member is permitted by the movement permitting means, the cover member can be retracted when no screw is thereby held, so that the bit body can protrude to a greater extent to facilitate the insertion of a screw into the bit body. Moreover, the magnetic force exerted by the magnetic attracting portion on the screw upon its insertion into the bit body causes the cover member to advance and hold the screw on its magnetic attracting portion.

Further, since the elastic annular member fitted in the circumferential groove is employed for restricting the back and forth movement of the cover member, the cover member can be detached from the holder body only by pulling it with a force causing the elastic deformation of the elastic annular member. The cover member can be fitted about the holder body easily only by elastically deforming the elastic annular member to force it into the circumferential groove. Moreover, the attachment and detachment of the cover member to and from the holder body can be easily done by a single hand. Accordingly, since the bit body can be changed by the detachment of the cover member by a single hand, any job of changing of the bit body can be done easily and quickly.

The bit body has a shank integrally formed with its rear portion, the cover member is fitted directly about the bit body, and there is provided movement permitting means between the inner surface of the cylindrical cover member and the outer surface of the bit body for permitting the axial back and forth movement of the cover member relative to the bit body. The movement permitting means consists of a circumferential groove formed in the outer surface of the bit body and an elastic annular member provided on the inner surface of the cover member to be engaged with the circumferential groove. The circumferential groove has an axial length which is greater than that of the elastic annular member, and the elastic annular member serves as the retaining means.

With this arrangement, when the bit body protruding from the front end of the cover member is inserted in the groove of the head of a screw, since the head of the screw is magnetically attracted to the magnetic attracting portion of the cover member, the screw can be held against separation from the bit body when it is attached to a workpiece, thereby facilitating any job of tightening, driving, or the like of a screw, etc.

When the bit body is securely inserted in the groove of a screw, etc, the cover member is moved toward the screw by the movement permitting means, enabling the magnetic attracting portion of the cover member to hold the screw.

Thus, the bit holder device can always hold any screw with the tip of its bit body fit completely in the head of the screw.

The elastic annular member engaged with the circumferential groove serves as a retainer, and the cover member having the elastic annular member is permitted to move back and forth to the extent defined by the axial length of the circumferential groove. Accordingly, the distance by which the cover member is permitted to move back and forth can be set by setting the axial length of the circumferential groove.

Moreover, the bit body can be changed only by detaching the cover member from the holder body. Accordingly, it is possible to save the trouble to loosen the chuck, etc. of an electric tool for changing the bit.

Advantages of the Invention

According to this invention, it is possible to drive a screw into a workpiece, while holding the screw with a groove thereof engaged with a bit body, and to change the bit body easily without loosening a chuck of an electric tool, etc. for removing the bit body.

BEST MODE OF CARRYING OUT THE INVENTION

Figure 1:
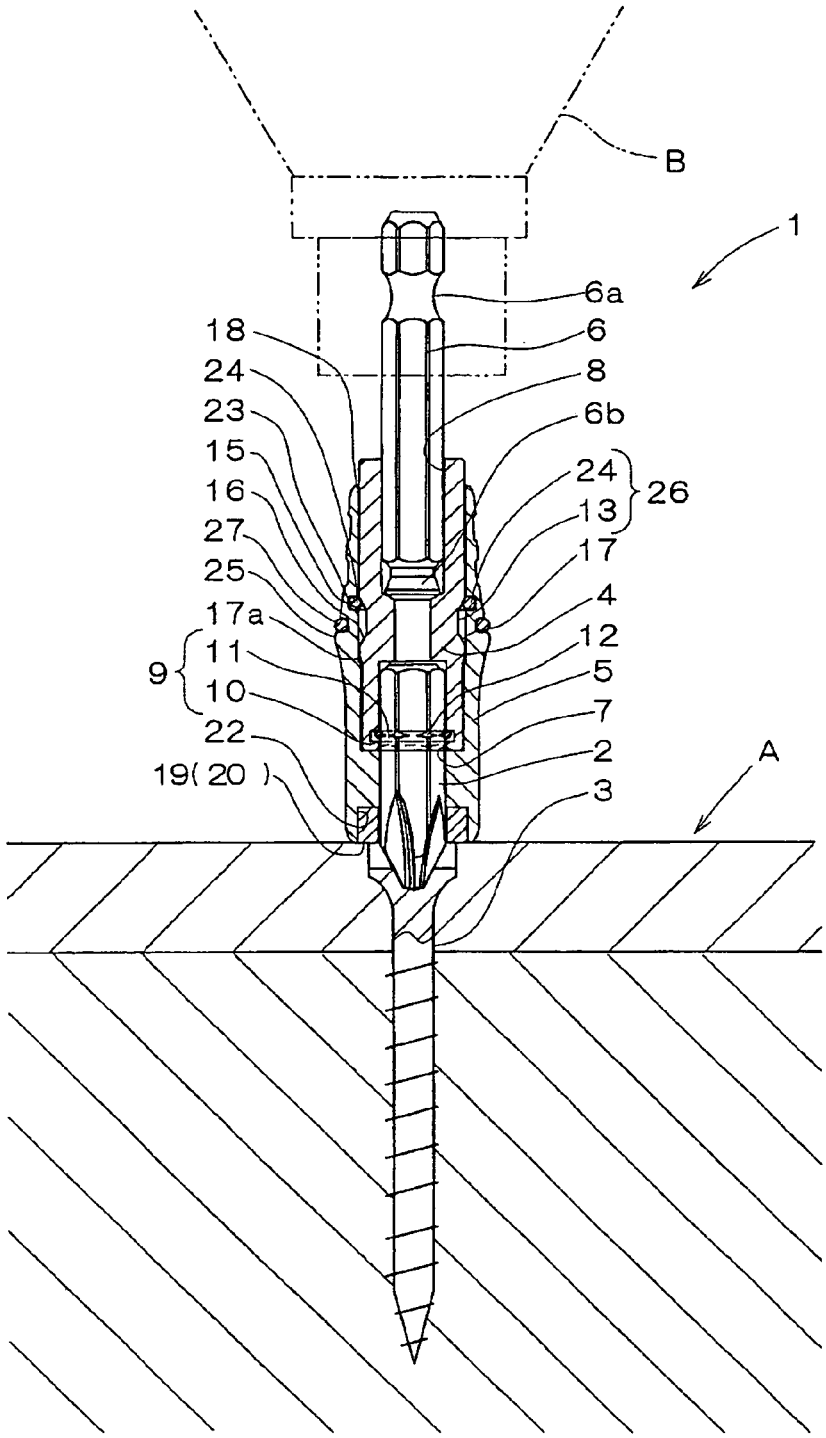
FIG. 1 is a longitudinal sectional view showing a bit holder device according to this invention when it holds a screw.

The best mode of this invention will now be described with reference to the drawings.

The bit holder device (screw catch bit holder device) 1 of this invention enables a job of tightening, driving, or the like of a screw 3, while holding the screw 3 against detachment from a bit body 2 rotatably attached to an electric rotating tool B, such as an electric screwdriver, and engaged with a groove on a head of the screw 3.

FIGS. 1 to 6 show a first embodiment of this invention.

The bit holder device 1 has a holder body 4 removably holding the bit body 2, and a cover member 5 to be attached to the holder body 4. The holder body 4 removably holds the bit body 2 in its front portion and has a shank 6 in its rear portion. The holder body 4 is made of a metal, and according to the embodiment under description, it is formed of stainless steel (for example, SUS304). The shank 6 is formed in the shape of a hexagonal column so as to be attached to the electric rotating tool B.

The holder body 4 is cylindrical (for example, circular cylindrical) and has a first holding port 7 for holding the bit body 2 at one longitudinal end thereof (hereinafter referred to as its front end). A second holding port 8 for holding the shank 6 is formed at the other end of the holder body 4 (hereinafter referred to as its rear end). The direction extending through the cylindrical (or axial) center of the holder body 4 is referred to as its longitudinal direction.

The first holding port 7 is formed with a regular hexagonal edge and the trunk portion of the bit body 2 having a hexagonal column shape is fitted therein. Holding means 9 for removably holding the bit body 2 is provided on the inner surface of the first holding port 7.

Figure 2:
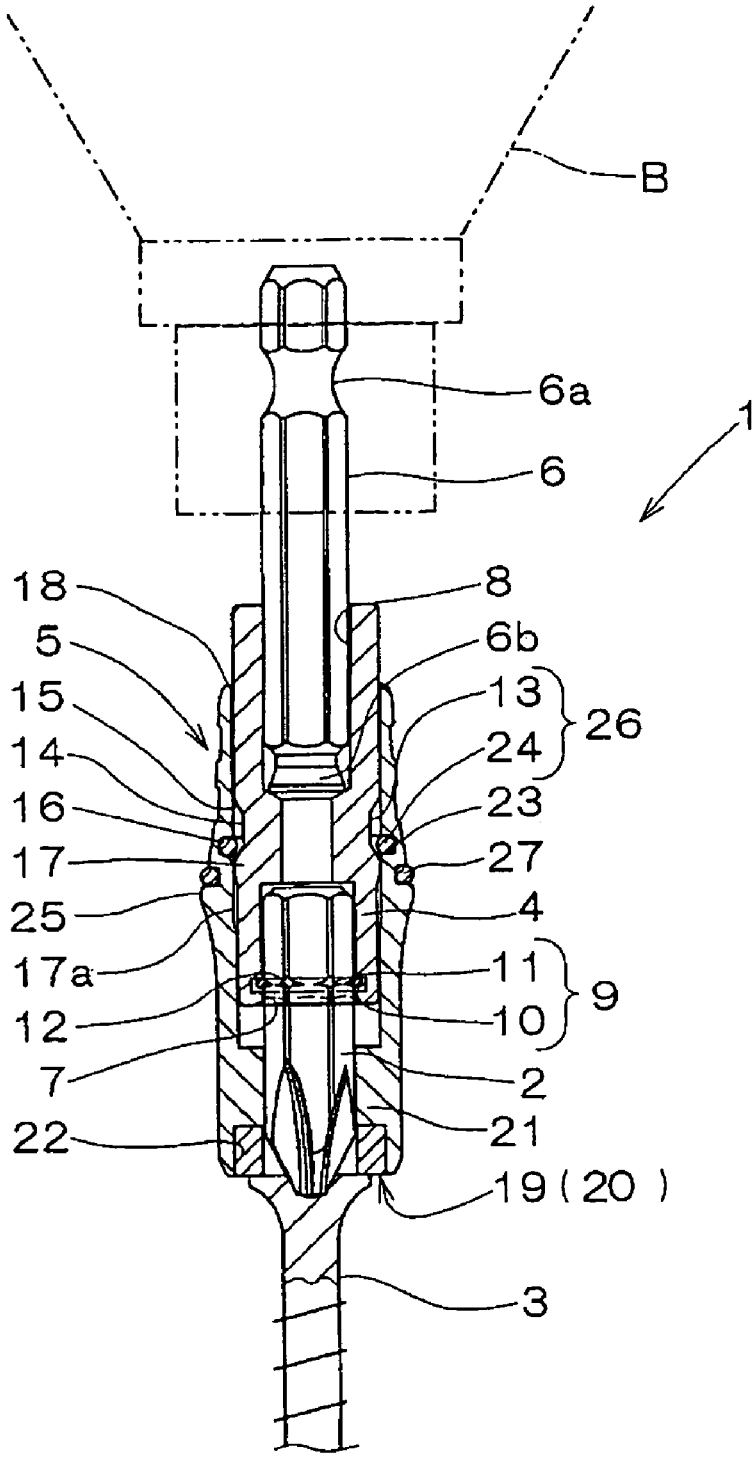
FIG. 2 is a longitudinal sectional view showing the bit holder device when it has driven the screw into a workpiece.
Figure 3:
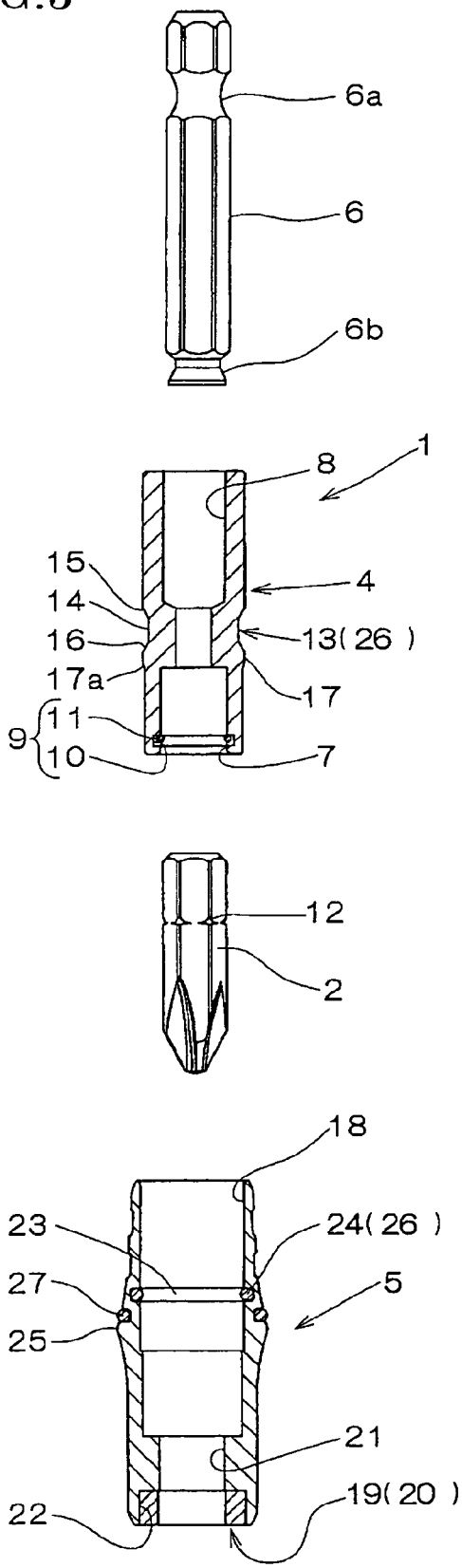
FIG. 3 is an exploded view of the bit holder device.

The holding means 9 has a groove 10 formed in the inner wall of the first holding port 7 about its axial center, and a stopper ring 11 fitted in the groove 10. The bit body 2 has a notch 12 formed at each corner of its shank portion, such that the stopper ring 11 is engaged with the notches 12 of the bit body 2 to retain the bit body 2 in position when the bit body 2 is fitted in the first holding port 7 and held by the holder body 4, as shown in FIGS. 1 to 3. The bit body 2 can be removed from the first holding port 7 by pulling out it only with a force causing the stopper ring 11 to be elastically deformed and disengaged from the notches 12.

The shank 6 has a circumferential groove 6*a* formed at one longitudinal end of its trunk portion (or its rear end), which serves as an attachment portion to the electric rotating tool B. The shank 6 has a head 6*b* formed at its front end and contacting the bottom of the second holding port 8. The head has a front end surface formed in a circular shape and at its front end, the head 6*b* has a diameter which is slightly smaller than the diameter of the inscribed circle of the regular hexagon of the trunk portion of the shank 6 in the shape of a hexagonal column.

The second holding port 8 is formed with a circular edge in the rear end surface of the holder body 4. The second holding port 8 has a diameter which is substantially equal to, or slightly larger than that of the head at its front end, and slightly smaller than that of the circumscribed circle of the regular hexagon of the shank 6 in the shape of a hexagonal column.

The holder body 4 has a circumferential groove 13 formed in the outer surface of its axially (or longitudinally) middle portion. The circumferential groove 13 is formed along the outer periphery of the cylindrical holder body 4. The circumferential groove 13 has a wall surface (hereinafter referred to as a rear wall surface 15), on the closer side to the second holding port 8, which is formed as a tapered (or inclined) surface reduced in diameter (or tapered) toward its front end (in the direction from the second holding port 8 to the first holding port 7).

The circumferential groove 13 also has a wall surface (hereinafter referred to as a front wall surface 16), on the closer side to the first holding port 7, which is formed as a tapered (or inclined) surface enlarged in diameter toward its front end (in the direction from the second holding port 8 to the first holding port 7). A straight portion 14 in a column shape is formed between the rear and front wall surfaces 15 and 16.

The holder body 4 has an annular raised portion 17 formed on its outer surface between the front wall surface 16 and the first holding port 7. The annular raised portion 17 has a wall surface 17*a*, on the closer side to the first holding port 7 (or on its front side), which is formed as a tapered (or inclined) surface reduced in diameter in the direction from the second holding port 8 to the first holding port 7.

The holder body 4 has in its trunk portion forward of its circumferential groove 13, or more specifically forward of its annular raised portion 17, a diameter which is equal to, or slightly smaller than the inside diameter of an elastic annular member 24 which will be described later.

The cover member 5 is cylindrically shaped so as to be removably fitted about the holder body 4. The cover member 5 has a port 18 formed at one longitudinal end thereof (hereinafter referred to as its rear end) for the insertion of the holder body 4 therethrough. The other end of the cover member 5 (hereinafter referred to as its front end) includes a magnetic attracting portion 19 for holding the screw 3. The magnetic attracting portion 19 has an annular magnet 20 and is fitted inside the front end of the cover member 5. The annular magnet 20 has a hole through which the bit body 2 extends and projects forward through the front end.

The cover member 5 has a radially inwardly projecting wall portion 21 formed on the inner surface of its axially intermediate portion and along its inner circumference. The wall portion 21 has a hole formed for the insertion of the bit body 2 therethrough. The wall portion 21 is formed to enable a concavity 22 in which the magnet 20 is fitted to be formed at the other end of the cover member 5. The wall portion 21 has a surface facing the other end of the cover member 5 and defining the bottom of the concavity 22.

The cover member 5 has a circumferential groove 23 formed along its inner circumference in the inner surface of its axially intermediate portion. The circumferential groove 23 is formed rearward of the wall portion 21. An annular body formed of an elastic material (hereinafter referred to as an elastic annular member 24) is fitted in the circumferential groove 23. An O-ring is, for example, used as the elastic annular member 24, which has a circular cross section and is disposed to project inwardly from the inner surface of the cover member 5.

The elastic annular member 24 is engaged with the circumferential groove 13 of the holder body 4 when the cover member 5 is put on the holder body 4, as shown in FIG. 1.

Specifically, under a state where the cover member 5 is put on the holder body 4, the elastic annular member 24 stays between the rear and front wall surfaces 15 and 16 of the circumferential groove 13 and is movable back and forth. The elastic annular member 24 has an inside diameter larger than the diameter of the straight portion 14 of the circumferential groove 13 of the holder body 4 and the elastic annular member 24 staying in the circumferential groove 13 is movable back and forth without contacting the straight portion 14.

The inside diameter of the elastic annular member 24 is smaller than the outside diameter of the annular raised portion 17 on the outer surface of the holder body 4, so that when the cover member 5 has moved to a forwardmost position, the elastic annular member 24 abuts the side surface of the annular raised portion 17 (or the front wall surface 16 of the circumferential groove 13) to prevent the detachment of the cover member 5 from the holder body 4. Thus, the elastic annular member 24 serves as retaining means for the cover member 5.

The cover member 5 radially outwardly bulges in an axially intermediate portion of its outer surface. This bulging portion 25 is formed to be caught by fingers pinching the cover member 5 so as to facilitate the application of a force for attaching the cover member 5 onto the holder body 4. The cover member 5 also has an elastic annular member 27 fitted on the outer surface of substantially its axially middle portion. The elastic annular member 27 is fitted in a circumferential groove formed adjacent to the bulging portion 25. An O-ring is, for example, used as the elastic annular member 27 and it serves as a slip stopper when the cover member 5 is detached from the holder body 4.

The cover member 5 has ridges and grooves formed on its outer surface between the elastic annular member 27 and the insertion port 18 and serving as a slip stopper when the cover member 5 is pinched.

The cover member 5 is fitted on the holder body 4 in a way as described below.

The insertion port 18 at one longitudinal end of the cover member 5 is placed about the front end of the bit body 2 attached to the holder body 4. Then, the cover member 5 is forced along the holder body, so that the front end of the holder body 4 is passed through the elastic annular member 24 in the cover member 5.

Figure 4:
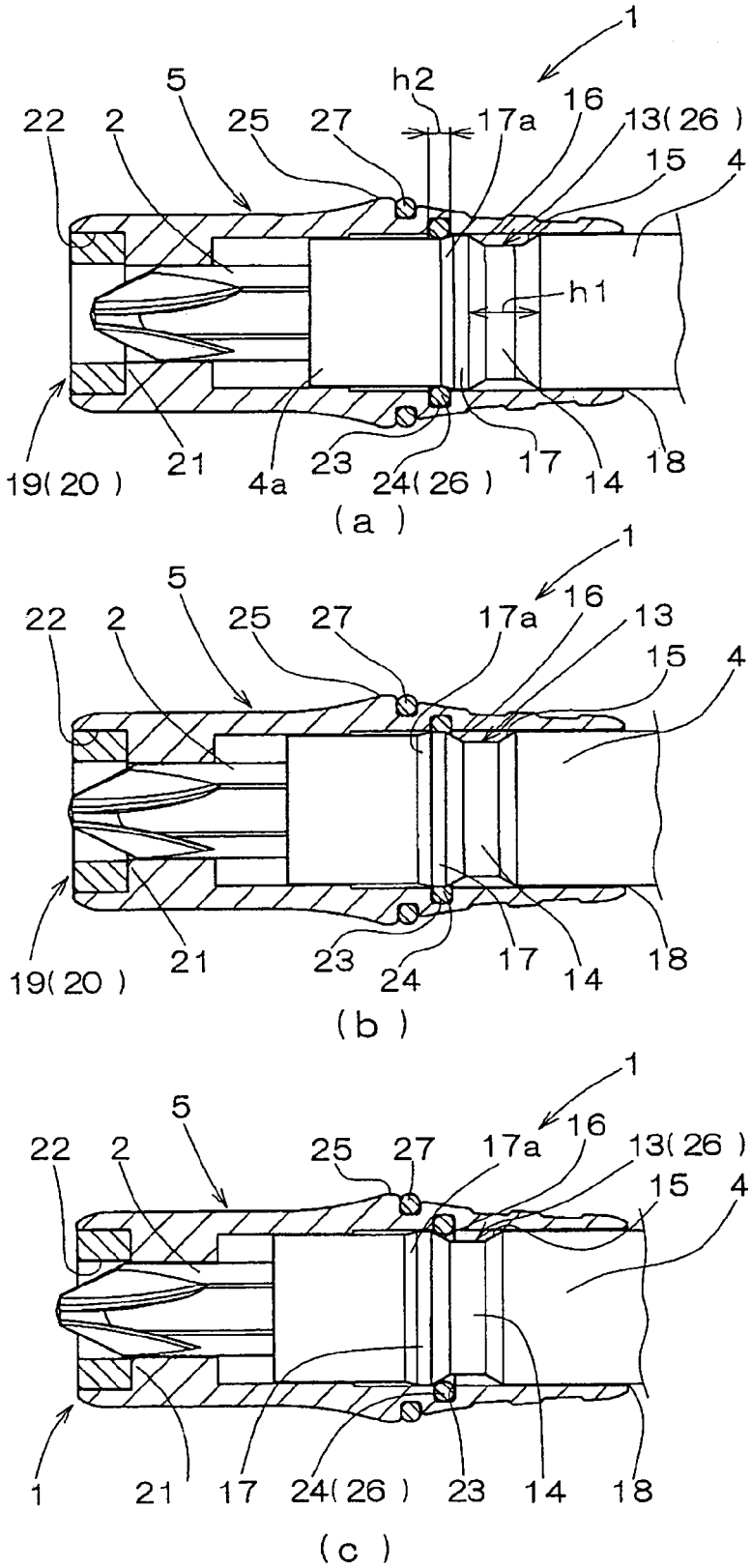
FIG. 4 includes a set of side elevational views showing a process in which a cover member is fitted on a holder body.
Figure 5:
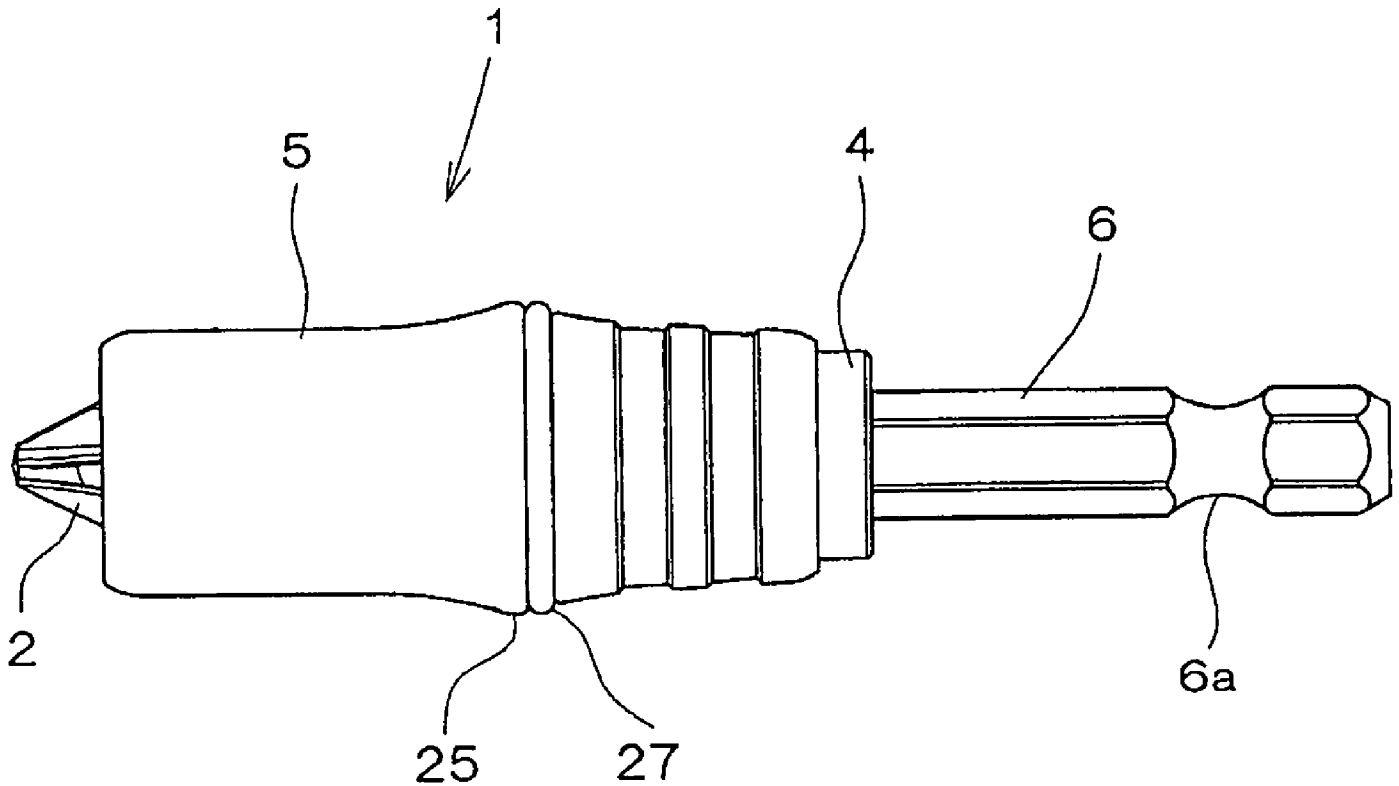
FIG. 5 is a side elevational view of the bit holder device.

When the cover member 5 is further forced along, the elastic annular member 24 abuts the wall surface 17*a* on the first holding port 7 side of the annular raised portion 17 formed on the outer surface of the holder body 4, as shown in FIG. 4(*a*). This wall surface will hereinafter be referred to as the abutting inclined surface 17*a*. When the cover member 5 is further forced along strongly, the elastic annular member 24 abutting the annular raised portion 17 is forced by the annular raised portion 17 to be elastically deformed with its inside diameter enlarged, as shown in FIG. 4(*b*).

When the cover member 5 is further forced along and the elastic annular member 24 has passed the annular raised portion 17, the elastically deformed elastic annular member 24 recovers its original shape by its restoring force and thereby engages with the circumferential groove 13 of the holder body 4, as shown in FIG. 4(*c*).

The axial length h1 of the circumferential groove 13 is larger (or longer) than the axial length of the elastic annular member 24 (i.e. the diameter of its circular cross section) h2 (see FIG. 4(*a*)). Accordingly, the elastic annular member 24 engaged with the circumferential groove 13 is allowed to move back and forth by a distance equal to the axial length of the circumferential groove 13. The circumferential groove 13 has a depth so selected that the elastic annular member 24 engaged with the circumferential groove 13 does not contact the surface of the straight portion 14.

The magnet 20 attracts with its magnetic force the bit body 2 of a magnetic material so that the front end of the bit body 2 protrudes from the cover member 5 through its front end opening. Accordingly, the front end of the bit body 2 protrudes forward from the front end surface of the magnet 20 when the elastic annular member 24 is engaged with the circumferential groove 13. Moreover, the front end surface of the holder body 4 abuts the rear end surface of the wall portion 21 of the cover member 5.

Since the magnetic force of the magnet 20 acts on the bit body 2 so that it protrudes forward through the front end of the cover member 5, a state of contact is maintained between the front end surface of the holder body 4 and the rear end surface of the wall portion 21 of the cover member 5.

The cover member 5 is fitted on the holder body 4 as described above, and since the abutting inclined surface 17*a* is a tapered (or inclined) surface reduced in diameter from the second holding port 8 to the first holding port 7, the elastic annular member 24 is gradually elastically deformed by the abutting inclined surface 17*a* when it has abutted on the abutting inclined surface 17*a* and is going to engage in the circumferential groove 13 as described above. Accordingly, since the elastic annular member 24 is neither too quickly deformed nor damaged by the top of the raised portion 17, the elastic annular member 24 advantageously has a prolonged life.

When the cover member 5 is pulled for its detachment from the holder body 4, the elastic annular member 24 abuts the front wall surface 16 of the circumferential groove 13. Accordingly, the elastic annular member 24 is gradually elastically deformed by the front wall surface 16, as in its elastic deformation by the abutting inclined surface 17*a*.

Since the trunk portion of the holder body 4 forward of its circumferential groove 13 has a diameter which is equal to, or slightly smaller than the inside diameter of the elastic annular member 24, the mere insertion of the front end of the holder body 4 through the elastic annular member 24 as described above hardly causes any elastic deformation of the elastic annular member 24.

Accordingly, no excessive frictional force acts between the elastic annular member 24 and the holder body 4, while the cover member 5 is moved until the elastic annular member 24 through which the front end of the holder body 4 is inserted abuts the abutting inclined surface 17*a* as described above. Therefore, since the cover member 5 can be moved without receiving any resistance until the elastic annular member 24 abuts the abutting inclined surface 17*a*, the cover member 5 can be fitted on the holder body 4 easily.

Figure 6:
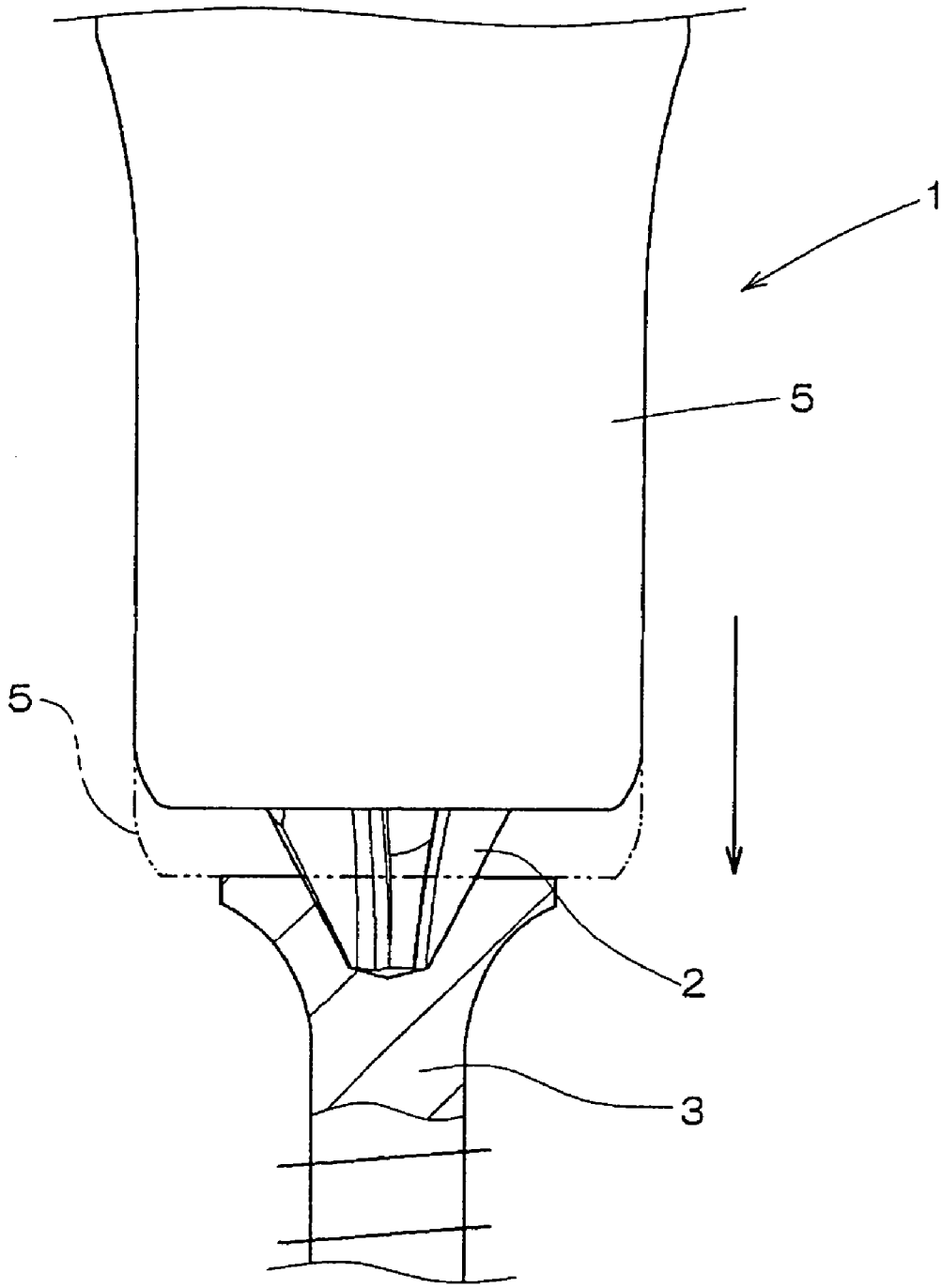
FIG. 6 is a side elevational view explaining the action in which the screw is magnetically attracted by the magnetic attracting portion of the cover member.

When the bit body 2 is inserted in the groove on the head of the screw 3 as shown in FIG. 6, the magnetic force of the magnet 20 acts on the head of the screw 3 to attract the screw 3. However, as the bit body 2 is inserted in the groove on the head of the screw 3, the head of the screw 3 is kept apart from the magnet 20 and is not movable toward the magnet 20.

However, since the cover member 5 is movable back and forth by the specific distance stated before, the magnetic force exerted on the screw 3 by the magnet 20 causes the cover member 5 to move toward the screw 3, and the front end surface of the cover member 5, or the front end surface of the magnet 20 magnetically contacts the surface of the head of the screw 3. As a result, the head of the screw 3 is securely held by the magnet 20 serving as the magnetic attracting portion 19, so that any screw 3 can be held in a stable position whenever it is driven into a workpiece A.

The cover member 5 is movable relative to the holder body 4 by the distance between the front and rear edges of the circumferential groove 13, since the elastic annular member 24 in the cover member 5 is allowed to move back and forth by the distance between the front and rear edges of the circumferential groove 13 when engaged with the circumferential groove 13 as stated above. Accordingly, this arrangement constitute movement permitting means 26 provided between the inner surface of the cover member 5 and the outer surface of the holder body 4 for permitting the axial back and forth movement of the cover member 5 relative to the holder body 4.

That is, the movement permitting means 26 includes the circumferential groove 13 formed in the outer surface of the cylindrical holder body 4; and the elastic annular member 24 provided on the inner surface of the cover member 5, engageable in the circumferential groove 13, and movable back and forth.

The front inclined portion of the bit body 2 is arranged to move back and forth across the front end surface of the magnet 20 in the cover member 5 when the cover member 5 moves. This is due to the fact that when the front end surface of the magnet 20 is positioned across the inclined portion of the bit body 2, the bit body 2 is magnetized by the magnet 20 and the bit body 2 itself becomes capable of holding the screw 3. Accordingly, the movement permitting means 26 serves also as restricting means for restricting the front end surface of the cover member 5 for movement in correspondence with the inclined portion of the bit body 2.

When the bit holder device 1 is used to drive the screw 3 into the workpiece A, such as wood, there are some cases in which the head of the screw is sunk below the surface of the workpiece A, as shown in FIG. 1. When the head of the screw 3 is sunk below the surface of the workpiece A, the front end surface of the cover member 5, or the outer end surface of the magnet 20 contacts the surface of the workpiece A, whereby the screw 3 and the magnet 20 are released from magnetic contact therebetween and the cover member 5 retracts relative to the holder body 4.

When the front end surface of the cover member 5 is in contact with the surface of the workpiece A, the front end surface of the holder body 4 is in contact with the rear end surface of the wall portion 21 of the cover member 5. These contacts make it possible to prevent any further extension of the bit body 2 attached to the holder body 4 and thereby any undesirable sinking of the screw 3 in the workpiece A.

Thus, the contact of the front end surface of the holder body 4 with the wall portion 21 of the cover member 5 restricts the movement of the bit body 2 so that the screw 3 may not sink in the workpiece A to any greater extent than is required.

Accordingly, the bit holder device 1 is provided with restricting means for restricting the movement of the bit body 2 to prevent sinking of the screw 3 in the workpiece A to any greater extent than is required, while allowing sinking of the screw 3 to a specific extent.

It is sufficient to detach the cover member 5 from the holder body 4 when changing the bit body 2 in the bit holder device 1 as described above, and it is possible to change the bit body 2 easily without loosening the chuck of an electric tool B, or the like and removing the holder body 4.

When changing the bit body 2, it is possible to change the bit body 2 only by removing the cover member 5. Accordingly, it is possible to eliminate the trouble to loosen the chuck of the electric tool B and detach the bit body 2, and it is advantageously possible to change the bit body 2 easily without having any annoyance.

Figure 7:
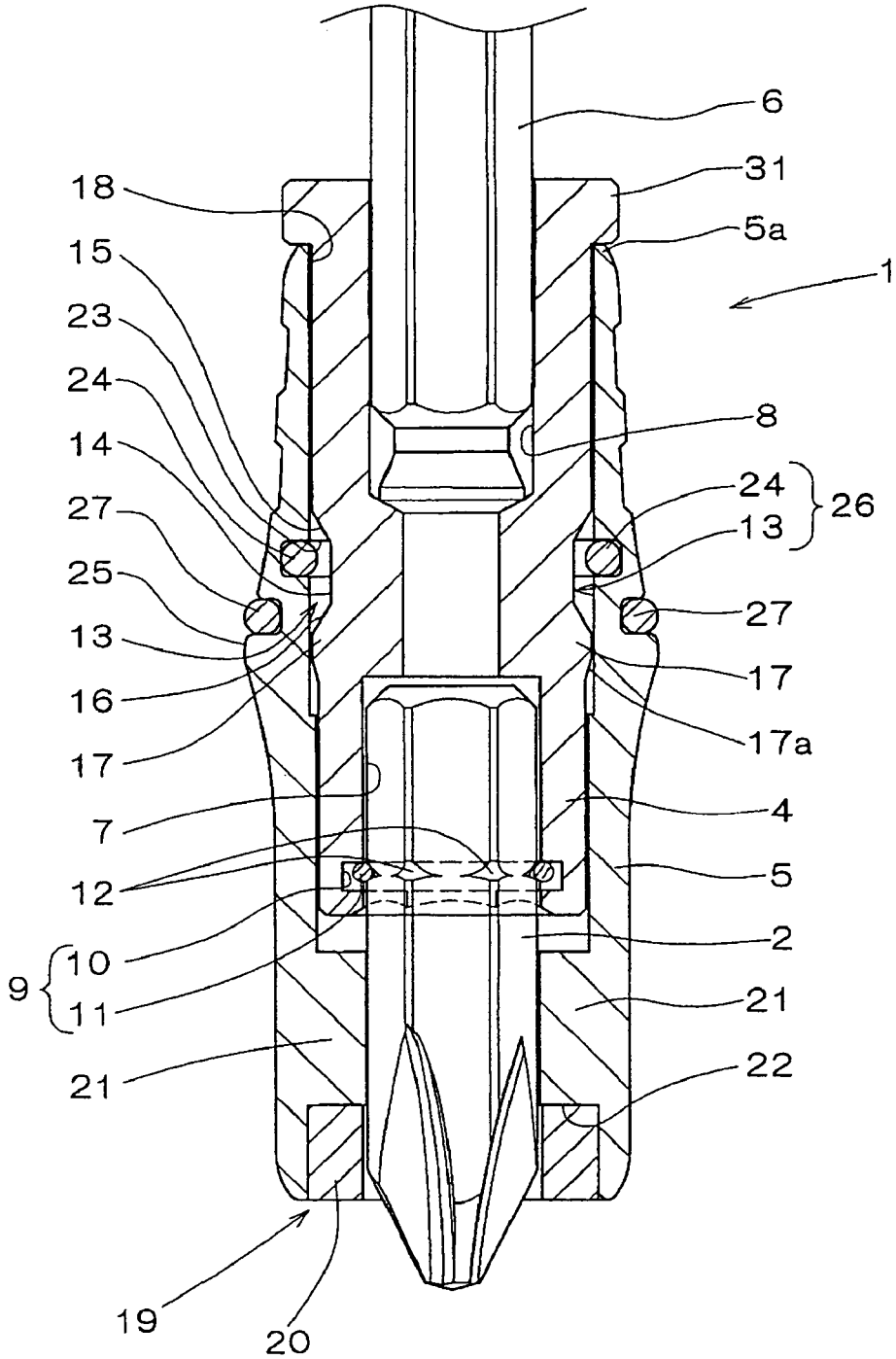
FIG. 7 is a longitudinal sectional view showing a bit holder device when it does not hold any screw.
Figure 8:
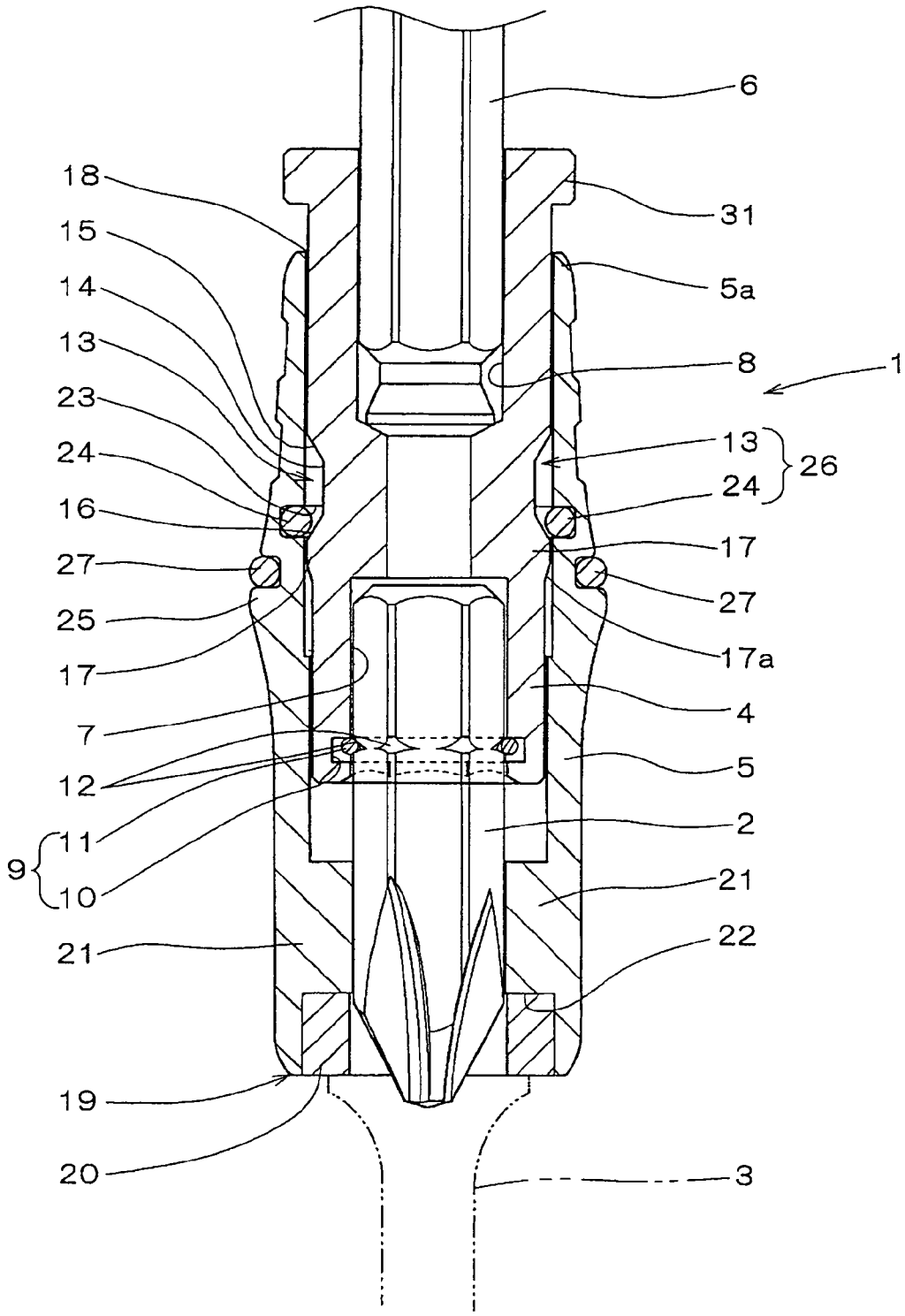
FIG. 8 is a longitudinal sectional view showing the bit holder device when it holds a screw.

FIGS. 7 and 8 show a second embodiment of this invention.

According to the second embodiment of the invention, a holder body 4 has a radially outwardly extending raised portion 31 formed at its rear end, which is a difference from the first embodiment. The raised portion 31 is formed along the whole circumference of the holder body 4 and in an annular shape.

When the bit holder device 1 does not hold any screw 3, the cover member 5 is in its standby position in which it is retracted relative to the holder body 4, and is positioned by its rear end 5*a* abutting the raised portion 31 of the holder body 4, as shown in FIG. 7. In this state, the front end of the holder body 4 is kept apart from the wall portion 21 of the cover member 5, and the raised portion 31 solely serves to position the cover member 5.

The raised portion 31 does not necessarily need to be annular, as long as it projects outwardly (radially outwardly) from the outer surface of the holder body 4 so that the rear end 5*a* of the cover member 5 abut it for positioning.

When a screw 3 is inserted in the bit body 2 shown in FIG. 7, the magnetic force exerted on the screw 3 by the magnetic attracting portion 19 of the cover member 5 causes the cover member 5 to advance, so that its magnetic attracting portion 19 holds the screw 3, as shown in FIG. 8.

According to the second embodiment, therefore, the raised portion 31 formed at the rear end of the holder body 4 enables the cover member 5 to be positioned in the same location at any time in its standby position without any screw 3 held, and as in the case of the first embodiment, the cover member 5 can be detached easily with a single hand and can be attached to the holder body 4 easily with a single hand again after the bit body 2 is changed, so that any job of changing the bit body 2 can be performed easily.

Other construction of this embodiment is equal to that of the first embodiment, and common symbols with the first embodiment are used to denote common parts (as will be the case with a third embodiment of the invention, too).

As an alternative in construction, the bit body 2 may be formed integrally with the shank 6 and formed with the circumferential groove 13 thereon to fit the cover member 5 on the bit body 2 removably without employing any holder body 4. In this case, too, the elastic annular member 24 and the circumferential groove 13 facilitate the attachment and detachment of the cover member 5 to and from the bit body 2.

Figure 9:
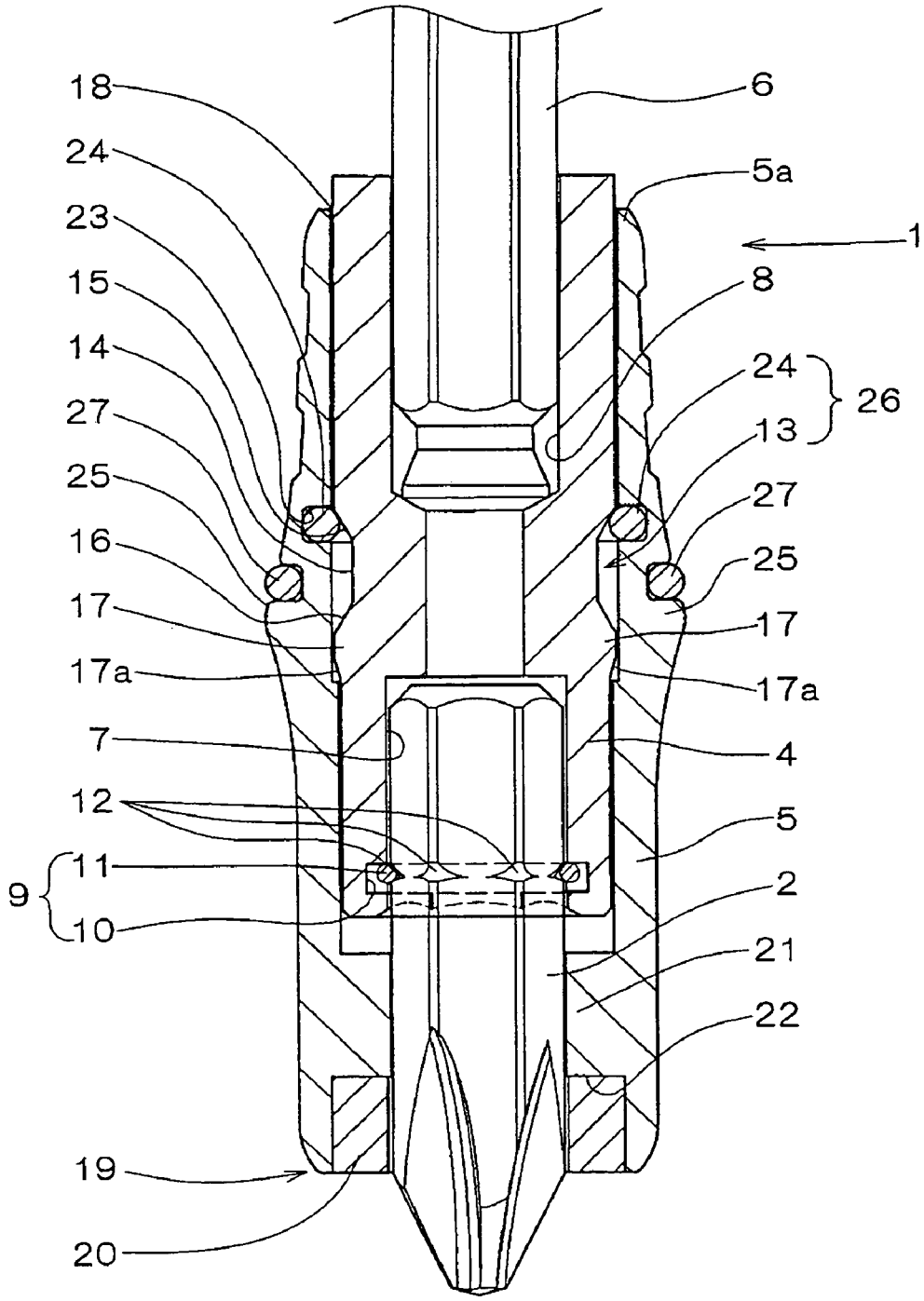
FIG. 9 is a longitudinal sectional view showing a bit holder device when it does not hold any screw.
Figure 10:
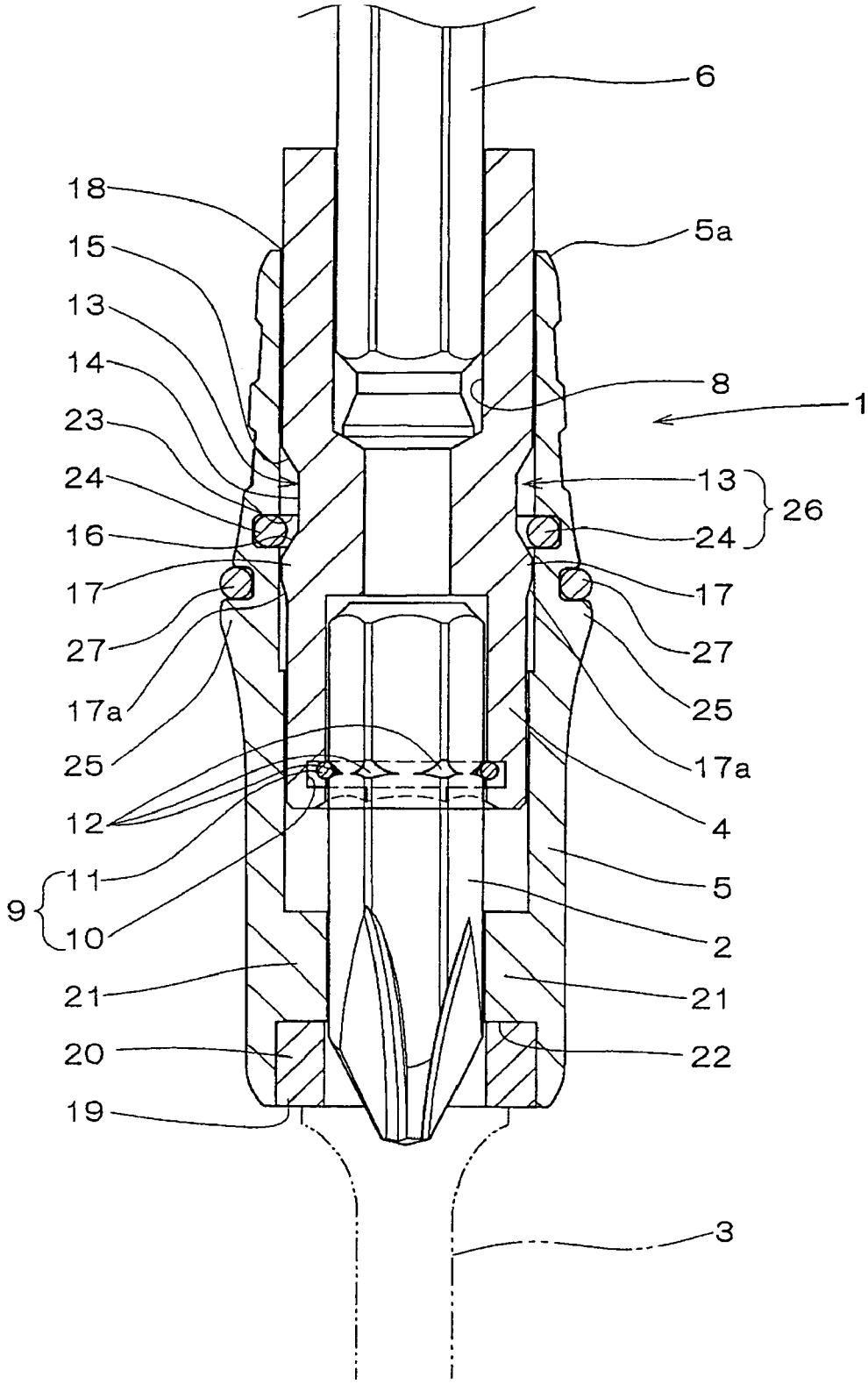
FIG. 10 is a longitudinal sectional view showing the bit holder device when it holds a screw.

FIGS. 9 and 10 show a third embodiment of this invention.

According to the third embodiment, an elastic annular member 24 provided on the inner side of a cover member 5 and a circumferential groove 13 formed on a holder body 4 limit (or restrict) the movement of the cover member 5. When the bit holder device 1 does not hold any screw 3, the cover member 5 is in its standby position in which it is retracted relative to the holder body 4, as shown in FIG. 9. In this position, the elastic annular member 24 on the inner side of the cover member 5 abuts the rear wall surface 15 of the circumferential groove 13 and the cover member 5 is so positioned as not to retract any more.

In this position, the holder body 4 has its front end stay away from the wall portion 21 of the holder body 4, and the positioning of the cover member 5 is effected solely by the contact of the elastic annular member 24 with the rear wall surface 15 of the circumferential groove 13.

When a screw 3 is inserted in the bit body 2 in this position, the cover member 5 advances and its magnetic attracting portion 19 holds the screw 3, as shown in FIG. 10.

The elastic annular member 24, which is situated between the rear and front wall surfaces 15 and 16 of the circumferential groove 13, allows the back and forth movement of the cover member 5 and serves as retaining means for retaining the cover member 5, while positioning it as described. In other words, the circumferential groove 13 and the elastic annular member 24 serve not only as the movement permitting means as stated before, but also as positioning means for positioning the cover member 5 in its standby position in which it is retracted, or as retaining means for preventing the cover member 5 from coming off.

As an alternative in construction, the bit body 2 may be formed integrally with the shank 6 and formed with the circumferential groove 13 thereon to fit the cover member 5 on the bit body 2 removably without employing any holder body 4. In this case, too, the elastic annular member 24 and the circumferential groove 13 facilitate the attachment and detachment of the cover member 5 to and from the bit body 2.

Figure 11:
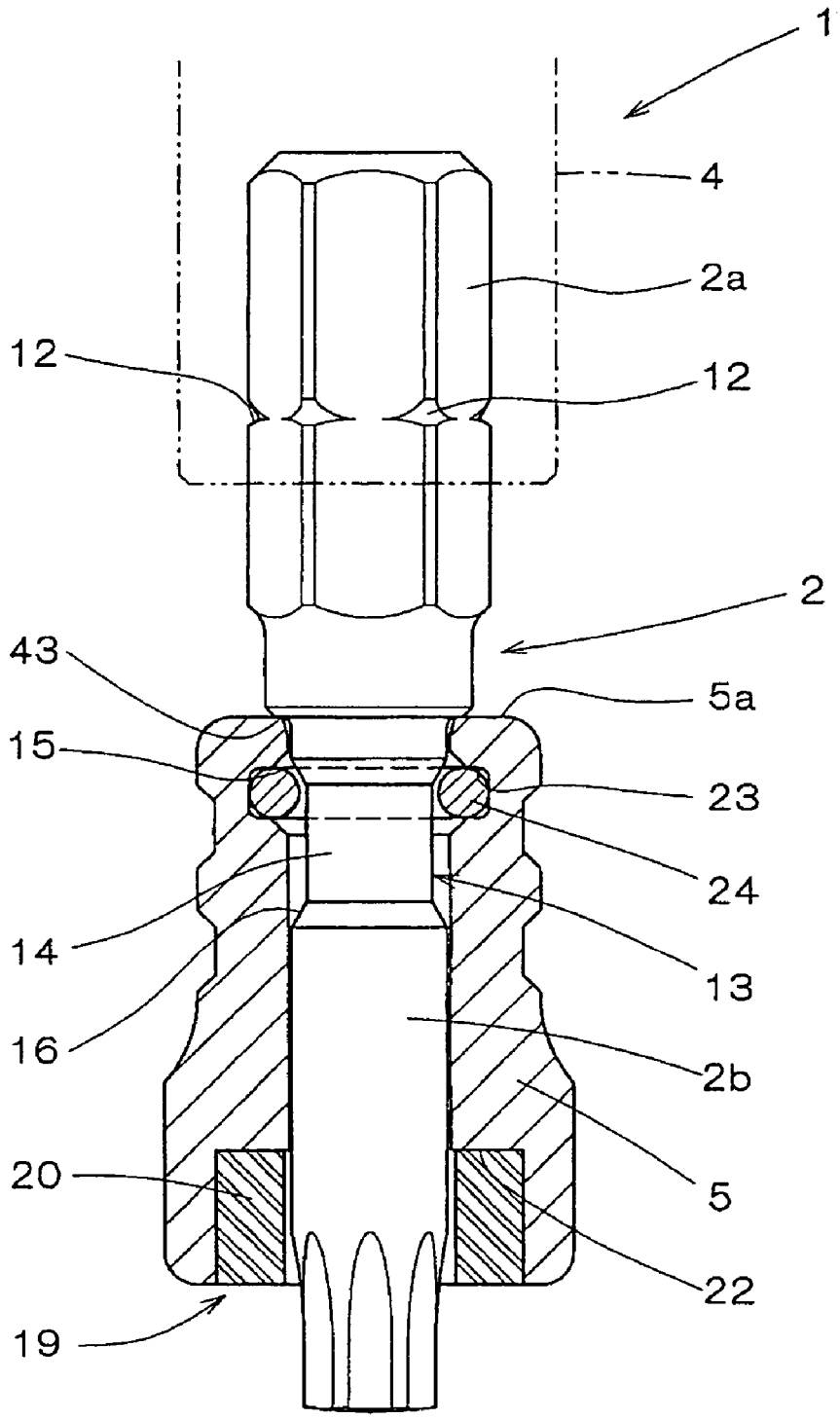
FIG. 11 is a longitudinal sectional view showing a bit holder device when it does not hold any screw.
Figure 12:
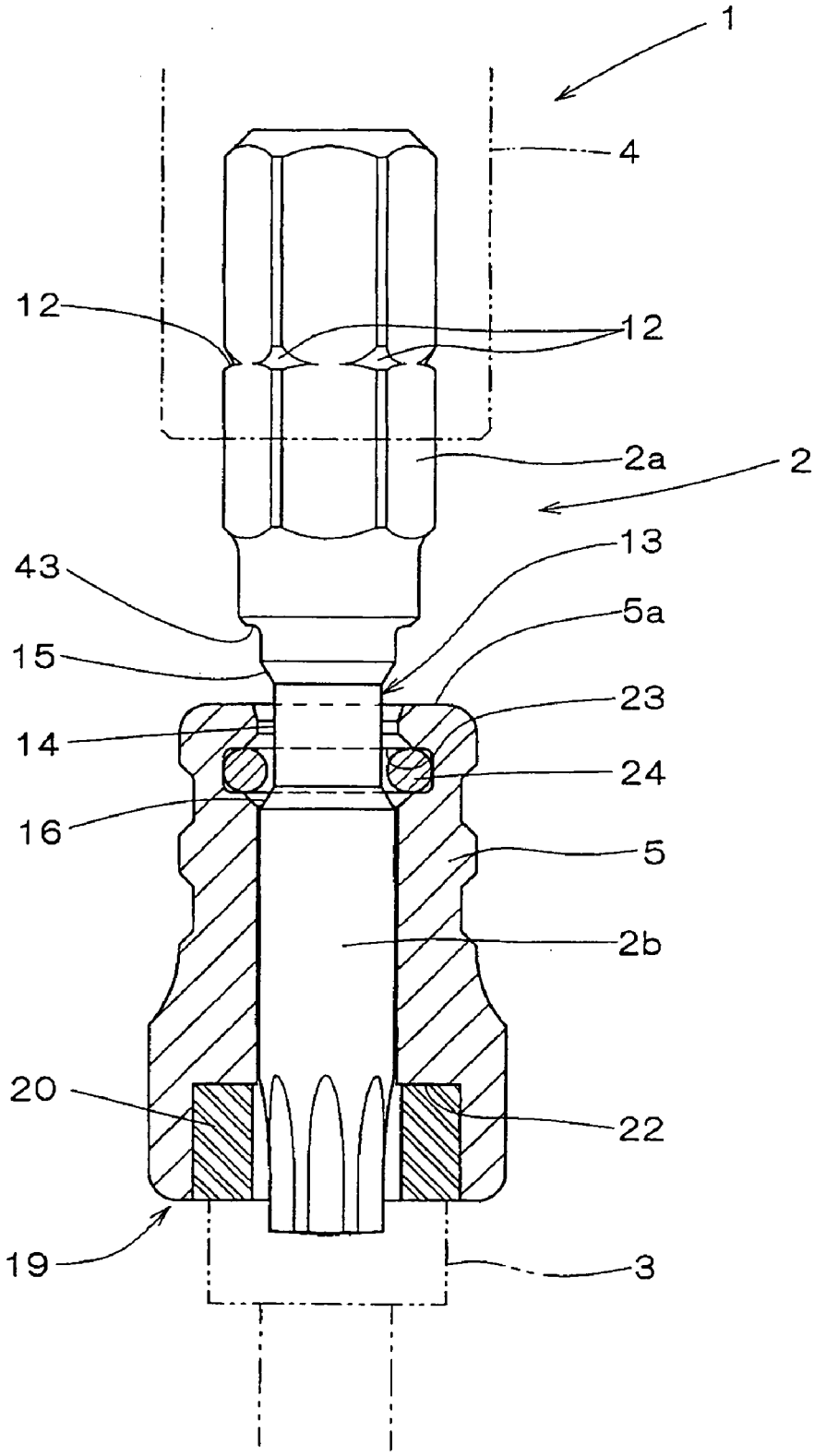
FIG. 12 is a longitudinal sectional view showing the bit holder device when it holds a screw.

FIGS. 11 and 12 show a fourth embodiment of this invention.

According to the fourth embodiment, a bit holder device 1 has a holder body 4, a bit body 2, and a cover member 5 fitted directly on the bit body 2 removably and holding a screw 3 by a magnetic force. The holder body 4 is equal to what is used according to the first to third embodiments.

The bit body 2 shown is of the so-called TORX type and has an irregularly shaped end which is engageable in the groove formed in the head of the screw 3. The bit body 2 has a rear portion 2*a* formed in the shape of a hexagonal column as according to the first to third embodiments. Its hexagonal column portion has notches 12 formed as described in connection with the first embodiment.

The bit body 2 has a front portion 2*b* shaped like a circular column and smaller in diameter than the rear portion 2*a* in the shape of a hexagonal column. The front portion 2*b* of the bit body 2 smaller in diameter than the rear portion 2*a* serves as a torsion portion which can absorb any excessive load bearing on the bit body 2 during work and thereby prolong the life of the bit body 2.

The cover member 5 is cylindrical and has an axial through bore in which the bit body 2 is inserted. The cover member 5 has an inside diameter which is slightly smaller than the diameter of the front portion 2*b* of the bit body 2 shaped like a circular column, so that the cover member 5 attached to the bit body 2 can move back and forth by a specific distance along the axis of the bit body 2.

The cover member 5 has a magnetic attracting portion 19 formed at one axial end thereof (or its front end). The magnetic attracting portion 19 has an annular magnet 20 as in the first to third embodiments of the invention.

The cover member 5 has a circumferential groove 23 formed in its inner surface along its circumference and an elastic annular member 24 fitted in the circumferential groove 23 as in the first embodiment. The elastic annular member 24 projects inwardly from the inner surface of the cylindrical cover member 5.

The circular column-shaped front portion 2*b* of the bit body 2 has a circumferential groove 13 formed in its outer surface along its circumference. The circumferential groove 13 has a rear wall surface 15 formed on the rear side of a circular column-shaped straight portion 14 as a tapered surface reduced in diameter as viewed toward the front end of the bit body 2 and a front wall surface 16 formed on the front side of the straight portion as a tapered surface enlarged in diameter as viewed toward the front end of the bit body.

The circumferential groove 13 has a width between its front and rear edges (or a length therebetween) which is longer than the axial length of the elastic annular member 24 (i.e. the diameter of its cross section) as in the first embodiment, so that when the cover member 5 is attached to the bit body 2, the elastic annular member 24 can move back and forth between the rear and front wall surfaces 15 and 16 of the circumferential groove 13.

When the cover member 5 is attached to the front portion 2*b* of the bit body 2, the elastic annular member 24 on the inner side of the cover member 5 is positioned between the front and rear wall surfaces 16 and 15 of the circumferential groove 13 of the bit body 2. The elastic annular member 24 and the circumferential groove 13 of the bit body 2 serve as movement permitting means for permitting the back and forth movement of the cover member 5 and retaining means for the cover member 5, as described in connection with the first embodiment of the invention.

When the bit holder device 1 does not hold any screw 3, the magnetic force exerted on the bit body 2 by the magnetic attracting portion 19 keeps the cover member 5 retracted relative to the bit body 2, as shown in FIG. 11. In this position, the cover member 5 is positioned by its rear end 5*a* abutting the boundary surface between the rear and front portions 2*a* and 2*b* of the bit body 2, i.e. the front end surface 43 of its hexagonal column-shaped portion. This enables the cover member 5 to stand by in the same position at any time when the bit holder device 1 does not hold any screw 3.

When the bit body 2 is inserted in the groove of a screw 3, the magnetic force exerted on the screw 3 by the magnetic attracting portion 19 causes the cover member 5 to advance and causes the magnetic attracting portion 19 to hold the screw 3, as shown in FIG. 12.

For changing the bit body 2, the cover member 5 is initially detached from the bit body 2, and then, the bit body 2 is detached from the holder body 4 and changed. In order to detach the cover member 5 from the bit body 2, since a force enabling the elastic annular member 24 to undergo elastic deformation and move over the front wall of the circumferential groove 13 suffices for pulling the cover member 5, it is possible to detach the cover member 5 from the bit body 2 easily with a single hand and it is also easy to attach the cover member 5 to the bit body 2.

Accordingly, it is advantageously possible to change the bit body 2 easily and quickly, since the cover member 5 is easy to attach and detach for changing the bit body 2.

It is also be possible to form the circumferential groove 13 in either the bit body 2 or the cover member 5 and provide the elastic annular member 24 on the other, as in the first embodiment.

Further, the rear portion of the bit body 2 may be formed integrally with the shank 6 so that the bit body 2 is directly attached to an electric rotating tool B without employing any holder body 4. Even in such a case, the elastic annular member 24 and the circumferential groove 13 facilitate the attachment and detachment of the cylindrical cover member 5 to and from the bit body 2.

Figure 13:
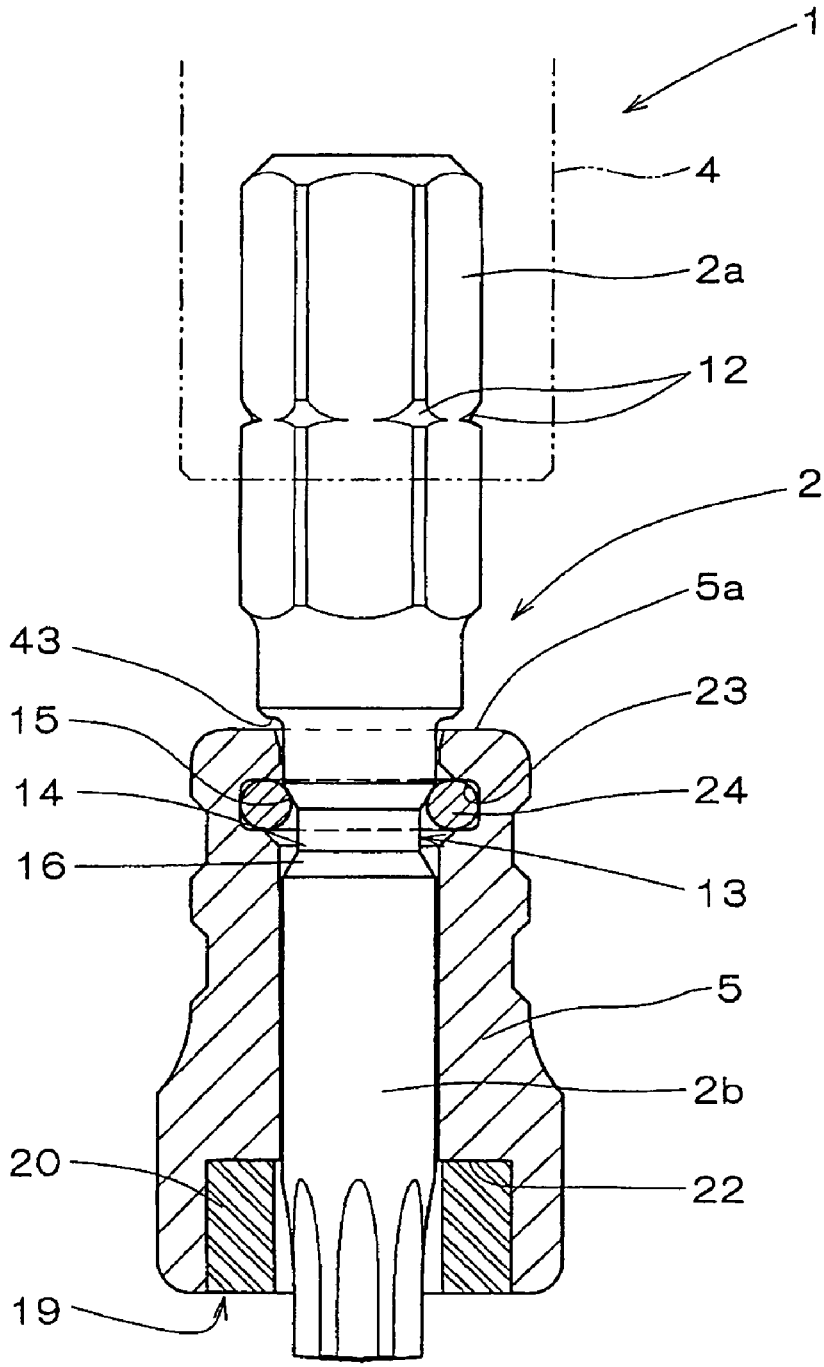
FIG. 13 is a longitudinal sectional view showing a bit holder device when it does not hold any screw.
Figure 14:
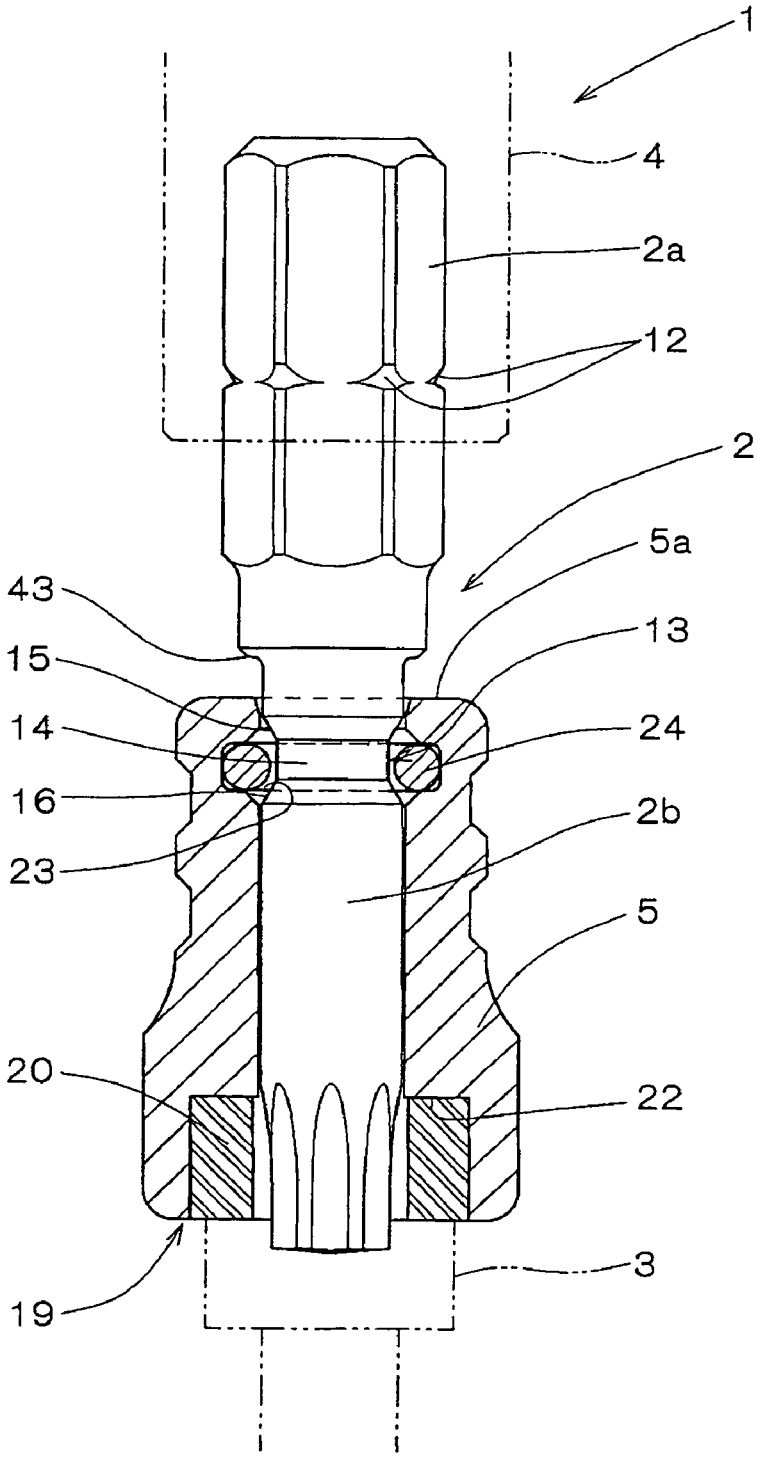
FIG. 14 is a longitudinal sectional view showing the bit holder device when it holds a screw.

FIGS. 13 and 14 show a fifth embodiment of this invention.

According to the fifth embodiment, an elastic annular member 24 provided on the inner side of a cover member 5 and an elastic annular member 24 provided between the front portion 2*b* of a bit body 2 and the inside of the cover member 5 restrict the back and forth movement of the cover member 5.

When the cover member 5 does not hold any screw, the cover member 5 stays retracted relative to the bit body 2 and is positioned by the elastic annular member 24 abutting the rear wall surface 15 of the circumferential groove 13 of the front portion 2*b* of the bit body 2 so as not to move back to any further extent. Thus, the elastic annular member 24 serves not only as retaining means as described in connection with the fourth embodiment of the invention, but also as positioning means for determining the standby position of the cover member 5 when the bit holder device 1 does not hold any screw 3. Other construction of this embodiment is equal to that of the fourth embodiment, and common symbols with the fourth embodiment are used to denote common parts.

The fifth embodiment of this invention also facilitates the detachment of the cover member 5 from the bit body 2 or its attachment and thereby any job of changing the bit body 2.

The bit body 2 may be formed integrally with the shank 6 so that the bit body 2 is directly attached to an electric rotating tool B without employing any holder body 4. Even in such a case, the elastic annular member 24 and the circumferential groove 13 facilitate the attachment and detachment of the cylindrical cover member 5 to and from the bit body 2.

It should be noted that this invention is not limited to any of the embodiments as described above.

Although the cover member 5 is provided with the elastic annular member 24, while the circumferential groove 13 is formed in the holder body 4, according to the first, second or third embodiment, it is alternatively possible to provide the holder body 4 with an elastic annular member 24 and form in the cover member 5 a circumferential groove 13 in which the elastic annular member is engageable.

Referring likewise to the fourth or fifth embodiment, it is possible to form the circumferential groove 13 in one of the front portion 2*b* of the bit body 2 and the cover member 5 and provide the other with the elastic annular member 24.

The position of the magnet 20 is not limited to the front end of the cover member 5. It is also possible to form the cover member 5 from a magnetic material and attach a magnet 20 to the sidewall of the trunk portion of the cover member 5 so that the magnet 20 may magnetize the front end of the cover member 5 to form a magnetic attracting portion 19 for holding screw 3.

Referring to the holding means 9 for holding the bit body 2, it is useful that the groove 10 formed in the inner wall of the first holding port 7 for fitting the stopper ring 11 therein have a distance between its front and rear edges which is slightly greater than the distance between the front and rear edges of the stopper ring 11. This provides a play to the bit body 2 when the bit body 2 is held in the first holding port 7. Accordingly, it is advantageously possible to allow the bit body 2 to retract from the groove on the head of a screw 3 so as to release the engagement therebetween without causing a damage to the groove in a case, for example, that an excessive load bears between the screw 3 and the bit body 2 when the screw 3 is completely driven into the workpiece A.

INDUSTRIAL APPLICABILITY

This invention is applicable to any product for holding a screw against disengagement from a bit body inserted in the groove on the head of the screw.

The invention claimed is:

1. A bit holder device for driving a screw, while holding the screw against detachment from a bit body and retaining a state where an end of the bit body is inserted in a groove on a head of the screw, the bit holder device comprising:

a cylindrical cover member removably fitted about the bit body from the end of the bit body, the cover member having an end including a magnetic attracting portion for magnetically attracting the head of the screw, the bit body protruding from the end of the cover member, the bit body being removably held by a holder body having a shank in its rear portion, and the cover member being fitted about the holder body; and a movement permitting device provided between an inner surface of the cylindrical cover member and an outer surface of the holder body, said movement permitting device permitting an axial back and forth movement of the cover member relative to the holder body, the movement permitting device comprising:

a circumferential groove formed in an outer surface of the cylindrical holder body; and an elastic annular member provided on an inner surface of the cover member to be engaged with the circumferential groove, the circumferential groove having an axial length which is greater than that of the elastic annular member.

2. The bit holder device as set forth in claim 1, wherein the circumferential groove of the holder body has a rear wall surface, a front wall surface, and a straight portion in a column shape between the rear and front wall surfaces, the front wall surface being formed as a tapered surface enlarged in diameter toward a front end of the holder body.

3. The bit holder device as set forth in claim 2, wherein the circumferential groove of the holder body has a depth so selected that the elastic annular member engaged with the circumferential groove does not contact the surface of the straight portion.

4. The bit holder device as set forth in claim 2, wherein the holder body has a holding port, the bit body being removably inserted into the holding port, and an annular raised portion is formed on an outer surface of the holder body between the front wall surface of the circumferential groove and the holding port.

5. The bit holder device as set forth in claim 4, wherein the holder body comprises a portion forward of the annular raised portion having a diameter which is equal to, or slightly smaller than an inside diameter of the elastic annular member.

6. The bit holder device as set forth in claim 1, wherein the magnetic attracting portion comprises an annular magnet provided at a front end of the cover member, and the bit body has a tapered end portion situated across a front end surface of the magnet.

7. The bit holder device as set forth in claim 1, wherein the holder body has a raised portion formed at a rear end of the holder body for positioning the cover member fitted about the holder body.

8. The bit holder device as set forth in claim 1, wherein the cover member is removably fitted about the holder body and held by a retaining device that prevents detachment from the bit body, the retaining device being formed of the elastic annular member to be engaged with the circumferential groove to allow the attachment and detachment of the cover member by a human force.

9. A bit holder device for driving a screw, while holding the screw against detachment from a bit body and retaining a state where an end of the bit body is inserted in a groove on a head of the screw, the bit holder device comprising:

a cylindrical cover member removably fitted about the bit body from the end of the bit body, the cover member having an end including a magnetic attracting portion for magnetically attracting the head of the screw, the bit body protruding from the end of the cover member, the bit body has a shank integrally formed with its rear portion, and the cover member is directly fitted about the bit body; and a movement permitting device provided between an inner surface of the cylindrical cover member and an outer surface of the bit body for permitting an axial back and forth movement of the cover member relative to the bit body, the movement permitting device comprising:

a circumferential groove formed in an outer surface of the bit body; and an elastic annular member provided on an inner surface of the cover member to be engaged with the circumferential groove, the groove having an axial length which is greater than that of the elastic annular member.

10. The bit holder device as set forth in claim 9, wherein the circumferential groove of the bit body has a rear wall surface, a front wall surface, and a straight portion in a column shape between the rear and front wall surfaces, the front wall surface being formed as a tapered surface enlarged in diameter toward a front end of the front wall surface.

11. The bit holder device as set forth in claim 10, wherein the circumferential groove of the bit body has a depth so selected that the elastic annular member engaged with the circumferential groove does not contact the surface of the straight portion.

12. The bit holder device as set forth in claim 9, wherein the magnetic attracting portion comprises an annular magnet provided at a front end of the cover member, and the bit body has a tapered end portion situated across a front end surface of the magnet.

13. The bit holder device as set forth in claim 9, wherein the cover member is removably fitted about the bit body and held by a retaining device that prevents detachment from the bit body, the retaining device being formed of the elastic annular member to be engaged with the circumferential groove to allow the attachment and detachment of the cover member by a human force.

* * * * *